US007886683B2

(12) United States Patent
Ageorges et al.

(10) Patent No.: US 7,886,683 B2
(45) Date of Patent: Feb. 15, 2011

(54) AUTOMOTIVE PAINT APPLYING INSTALLATION AND METHOD USING SAME

(75) Inventors: Gérard Ageorges, Sevres (FR); Thierry Mandard, Nezel (FR)

(73) Assignee: Renault SAS, Boulogne-Billancourt (FR)

( * ) Notice: Subject to any disclaimer, the term of this patent is extended or adjusted under 35 U.S.C. 154(b) by 839 days.

(21) Appl. No.: 11/629,991

(22) PCT Filed: May 30, 2005

(86) PCT No.: PCT/FR2005/050389

§ 371 (c)(1),
(2), (4) Date: Aug. 29, 2007

(87) PCT Pub. No.: WO2006/005860

PCT Pub. Date: Jan. 19, 2006

(65) Prior Publication Data

US 2008/0118652 A1 May 22, 2008

(30) Foreign Application Priority Data

Jun. 21, 2004 (FR) ..... 04 06717

(51) Int. Cl.
*B05C 15/00* (2006.01)

(52) U.S. Cl. ..... 118/300; 118/314; 118/315

(58) Field of Classification Search ..... 118/314, 118/315

See application file for complete search history.

(56) References Cited

U.S. PATENT DOCUMENTS

| | | | | |
|---|---|---|---|---|
| 4,537,280 | A | 8/1985 | Roberts | |
| 5,058,812 | A | 10/1991 | Cox et al. | |
| 5,090,743 | A | 2/1992 | Obering | |
| 5,221,047 | A * | 6/1993 | Akeel | 239/123 |
| 5,882,428 | A * | 3/1999 | Gawne | 134/8 |
| 6,090,450 | A | 7/2000 | Kahmann et al. | |
| 2003/0111118 | A1 * | 6/2003 | Diana | 137/606 |

FOREIGN PATENT DOCUMENTS

| | | |
|---|---|---|
| EP | 1 319 441 | 6/2003 |
| FR | 2 562 983 | 10/1985 |
| WO | 2004 009247 | 1/2004 |

* cited by examiner

*Primary Examiner*—Parviz Hassanzadeh
*Assistant Examiner*—Albert Hilton
(74) *Attorney, Agent, or Firm*—Oblon, Spivak, McClelland, Maier & Neustadt, L.L.P.

(57) ABSTRACT

An automotive paint installation providing additionally to standard paint application, automated application of small rare color shade paint volumes. The installation includes at least a secondary rare color shade paint dispensing and recovery circuit, wherein scrapers are circulated in the part of the circuit supplying painting stations, and including a distribution device for directing the fluid exiting the painting stations towards paint, solvent, or recovery vessels. A plurality of connecting pipes connect each secondary circuit to a painting station, and are provided each with a bleeding system to enable recovery and bleeding to be performed during application of a current paint color shade. A rare color shade point dispensing and recovery method use such an installation.

8 Claims, 3 Drawing Sheets

F
36
C3
C4
37
C2
1
2
26
R
P2
P1
44
24
40
45
39
38
46
48
47
41
43
42
25
S
11

AUTOMOTIVE PAINT APPLYING INSTALLATION AND METHOD USING SAME

BACKGROUND

The invention relates to an automobile painting installation and a method using such an installation.

Installations for dispensing and applying paint to motor vehicles generally comprise a plurality of painting stations, manual or automatic, each connected to a plurality of paint dispensing circuits. Each paint dispensing circuit corresponds to a particular color and supplies each application station from a paint tank. The paint is circulated in the circuit to prevent it from deteriorating.

At each application station, the paint color to be applied is selected by a color change device, called a color changer, comprising a plurality of valves of which the inlet is connected to a paint dispensing circuit by a line and of which the outlet is connected to a feed line connected to the paint application device of the station. Between two applications of paint of different colors, this feed line is rinsed using a bleed system. The opening of the color changer valves is automated in order to automate the application of the paint.

The frequent use of the paint colors demands large capacity paint tanks, which must consequently be kept at some distance from the application stations for reasons of size, so that long pipe lengths are necessary. Due to the size of these dispensing circuits, a large quantity of paint is required to fill them (about 1 to 3 tons).

Dispensing circuits of this size are inconceivable for rarely used paint colors, especially since a small quantity of paint, about five liters, is needed to paint a car. These colors are hence usually applied manually but with a finish inferior to that of the common colors applied automatically. In certain installations, smaller tanks are positioned closer to the application stations to also reduce the length of the dispensing circuit. However, a non-negligible volume of paint is still necessary to load the dispensing circuit (several hundred liters) and the paint must be circulated permanently. Moreover, if the consumption of paint is too low, the paint deteriorates so that the quality and color are no longer satisfactory, and the product must be destroyed and replaced.

Thus, up until the present, the automatic installations used to apply a rare color paint to a vehicle, to obtain a good quality finish, require quantities of paint which are disproportionate to the quantities actually applied, so that a large quantity of paint deteriorates.

Furthermore, space considerations around each color changer preclude the direct connection of a dispensing circuit to a changer valve, making it necessary to use a line connecting the circuit to the changer. A color change or a circuit cleaning accordingly requires cleaning this connecting line. Such a bleed can only be obtained today using the color changer, implying the shutdown of the painting station and a decrease in the paint application rate in the installation.

Documents U.S. Pat. No. 6,090,450 and U.S. Pat. No. 5,221,047 describe methods and devices for recovering or cleaning the feed line between the color change device and the paint application device. In document U.S. Pat. No. 5,221,047, the paint is pushed in the feed line using a scraper, up to the application device. All the paint is thus used and a return line repositions the scraper at the inlet of the feed line. This first scraper is followed by a given quantity of solvent, and then by air following a second scraper, in order to clean the feed line. In document U.S. Pat. No. 6,090,450, a scraper circulates back and forth in the feed line. At the end of the paint application, the scraper pushes the remaining paint outside the line and the application device, and is then returned to its starting point. However, these cleaning methods are only used on a short length of feed line, and not for a larger closed circuit.

There is therefore a need for an automobile painting installation which, in addition to the known paint application, permits the automated application of paints of a rare color with low circulation, the recovery of the unused paint, and the bleeding of the system. These recovery and bleed steps must preferably be carried out without reducing the automated rate of paint application to the vehicles, that is, during the application of a common paint color.

BRIEF SUMMARY

For this purpose, the subject of the invention relates to an automobile painting installation comprising a plurality of painting stations each connected to a plurality of main common color paint dispensing circuits, each painting station comprising an application device supplied with paint via the outlet of a main color changer provided with a bleed system, each main color changer comprising a plurality of inlet valves each connected to a main common color dispensing circuit, the valves and application devices being controlled by a control system, characterized in that it further comprises a secondary rare color paint dispensing and recovery system controlled by the control system comprising at least one secondary paint dispensing and recovery circuit supplying the plurality of painting stations, with smaller dimensions compared with the main circuits, the secondary circuit comprising:

- a scraper storage and circulating system of which the inlet and the outlet are connected respectively downstream and upstream of the painting stations to circulate the scrapers in the part of the circuit supplying the stations,
- at least one rare color paint tank, one solvent tank and one spent solvent recovery tank, connected upstream of the outlet of the scraper storage system,
- a dispensing device connected to the inlet of the scraper storage system, to send the fluid exiting the painting stations to the paint, solvent or recovery tanks,
- a plurality of connecting lines of which one end is connected to the secondary circuit by a flush three-way valve and the other end is connected to an inlet valve of a main color changer, each connecting line being provided with an independent bleed system to bleed it between the flush three-way valve and the inlet valve of the main color changer.

The reduced dimensions of the secondary dispensing and recovery circuit serve to reduce the quantity of rare color paint used. Moreover, the scraper circulation system associated with the dispensing device serves to recover the excess rare color paint at the outlet of the painting stations and store it appropriately in a tank. This makes it unnecessary to circulate the paint in the circuit to prevent its deterioration, and only the paint tank is maintained with stirring. The use of flush valves between the secondary circuit and the connecting lines serves to improve the capacity to recover paint by the scrapers, the specific cleaning of these valves therefore being superfluous.

Furthermore, the independent bleed system of each connecting line permits its cleaning during the bleeding of the secondary circuit, without requiring the shutdown of the main color changers which dispense another paint color originating from a main circuit. Cleaning operations on the connecting line and the secondary circuit can thus be performed in masked time without affecting the production rate of the installation.

Advantageously, a secondary color changer is connected to each connecting line, the outlet of the color changer being connected to the inlet valve of the corresponding main color changer, and which comprises at least one inlet valve connected to a secondary circuit via the flush three-way valve. This color changer, with a similar structure to the main color changers, can be connected to a single secondary circuit. One or more rare colors can then be applied according to the number of paint tanks connected to this circuit. As a preferable alternative, this changer is connected to two or more secondary circuits, each comprising one or more paint tanks.

Advantageously, each secondary circuit and/or each bleed system of a connecting line is connected to a compressed gas feed. Blowing gas through the entire secondary circuit and/or the connecting lines serves to remove any traces of solvent subsisting after the cleaning.

Advantageously, the scraper storage and circulating system comprises a storage trap of which the inlet and outlet are controlled by solenoid valves. The entry and exit of the scrapers can thus be automated.

Advantageously, the storage trap has a substantially L-shaped tubular shape, of which the upper and lower ends form the inlet and the outlet respectively, the scrapers being stored in the substantially vertical part. The scraper introduction and recovery system is thus compact, and suitable for rapidly and easily placing, by gravity, each scraper entering the trap, in a position in which it is ready to be reintroduced into the circuit.

The invention further relates to a rare color paint dispensing and recovery method using an installation according to the invention, characterized in that it comprises the steps consisting in:

pushing, between two scrapers, a predetermined quantity of paint in a secondary dispensing circuit to feed the painting stations via the connecting lines, sending the unused paint leaving the painting stations to the paint tank using the dispensing device, then rinsing the secondary circuit by circulating solvent between scrapers, the flush valves between the secondary circuit and the connecting lines being closed, bleeding the connecting lines using their independent bleed system, the valves via which they are connected to the main color changers and to each secondary circuit being closed.

The unused paint is thus recovered between each use, and the secondary circuit is cleaned, thereby considerably limiting the paint losses. The secondary circuit can then be used later to dispense paint of the same color, or another color.

Advantageously, the secondary circuit is rinsed by introducing two predetermined quantities of solvent separated by a scraper following a scraper according to the quantity of paint, at least part of the second quantity of solvent introduced being sent to the solvent tank using the dispensing device. Smaller quantities of solvent are thus used. The use of scrapers also serves to recover part of the second quantity of solvent and thereby reduce the solvent consumption.

Advantageously, when each secondary circuit is provided with scraper sensors, some of the steps of paint introduction, recovery and bleeding of the secondary circuit are controlled by the control system in response to detection signals transmitted by the scraper sensors.

BRIEF DESCRIPTION OF THE DRAWINGS

The invention is now described with reference to the drawings appended hereto, which are nonlimiting, in which.

DETAILED DESCRIPTION

In these figures, the arrows indicate the fluid flow direction.

Figure 1:
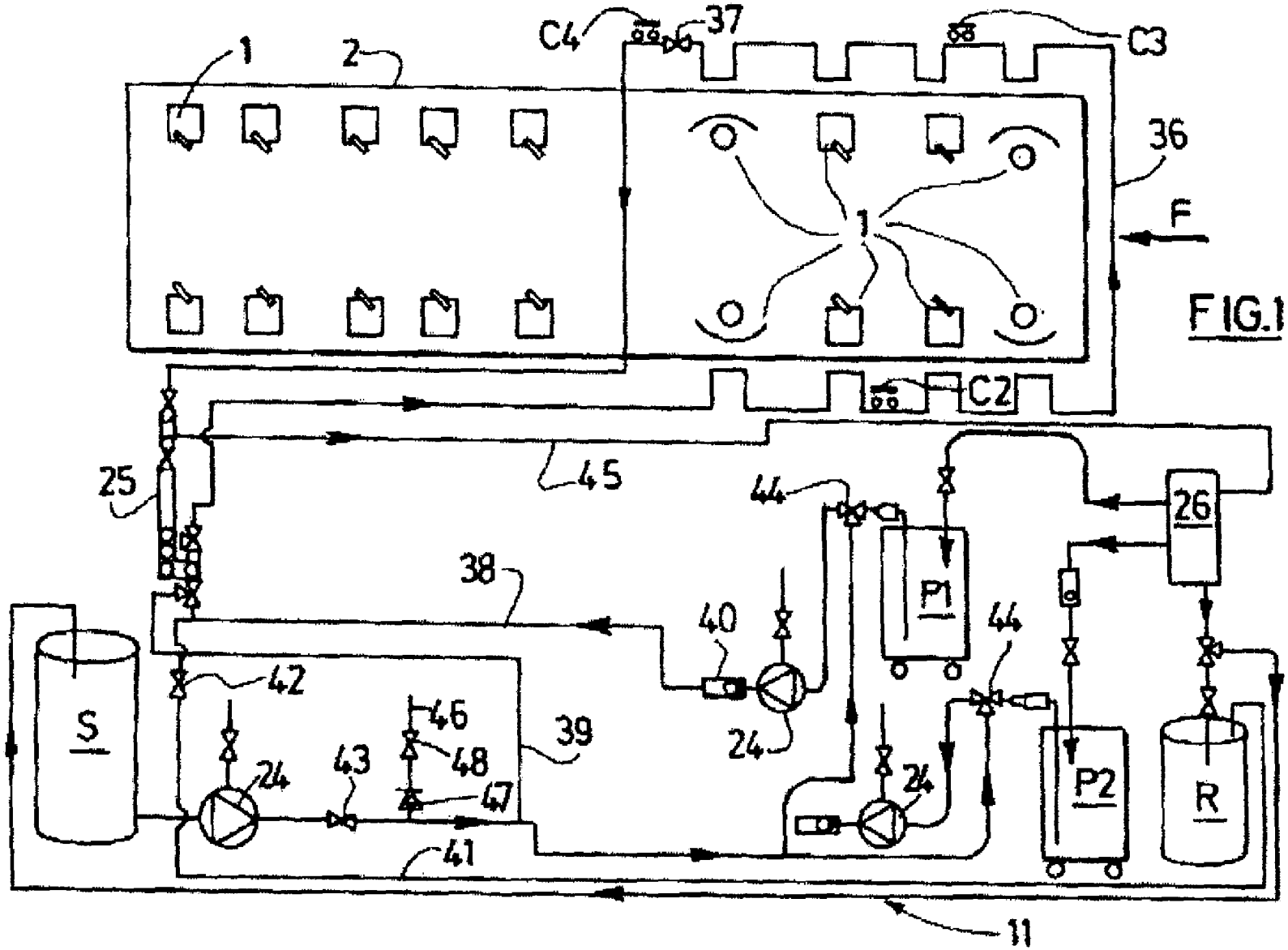
FIG. 1 is a schematic representation of an installation according to the invention.

FIG. 1 shows an automobile painting installation according to the invention.

The installation comprises a plurality of painting stations 1, manual or robotized, arranged in a cabin 2 into which the vehicles to be painted are introduced in the direction of the arrow F in FIG. 1.

Figure 2:
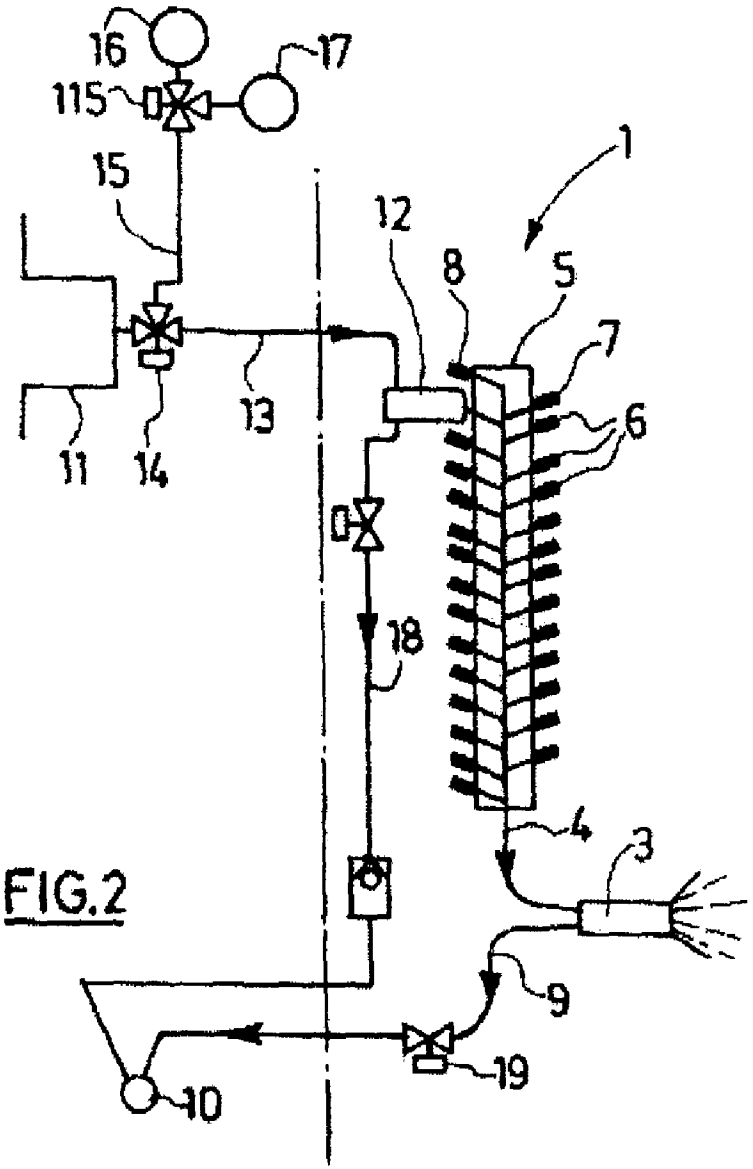
FIG. 2 is a schematic representation of a connecting line connecting a secondary circuit to a painting station.

Each painting station 1 comprises an application device 3 supplied with paint via an outlet line 4 of a main color changer 5, as shown in FIG. 2. In this figure, the broken line represents the wall of the cabin 2. Each main paint changer 5 comprises a plurality of paint inlet valves 6.

Each inlet valve is connected on the one hand to a main paint dispensing circuit (not shown) and, on the other, to the paint outlet line 4. The main paint dispensing circuits are conventional and are not described. They are used to apply the commonly applied paint colors and referred to below as "common colors". In practice, each valve is connected to a paint dispensing circuit corresponding to a predetermined common color.

Each main paint changer is further provided with a bleed system comprising two valves 7 and 8 upstream of the inlet valves 6 and connected respectively to a solvent feed and a compressed gas feed (not shown). The latter is generally compressed air, while the solvent is selected according to the type of paint. The bleed system also comprises a discharge line 9 connected to the application device 3 and leading to a bleed manifold 10.

A main color changer 5 is thereby bled as follows: after the application of a paint, the inlet valves 6 are all closed, the solvent inlet valve 7 is then opened and the solvent flows into the outlet line 4, passes through the application device 3, and then into the discharge line 9, and is recovered in the bleed manifold 10. The solvent inlet valve 7 is then closed and the compressed gas inlet valve 8 is opened to allow the gas to enter along the same route and to dry the interior of the lines. This valve is then closed and another paint inlet valve 6 can be opened to apply a different color.

All the valves 6 to 8, and the application devices 3, are controlled by a control system (not shown). Obviously, other bleed systems can be used.

Each main color changer 5 is also connected to a secondary paint dispensing circuit 11 for applying a less commonly employed color, called "rare color". For this purpose, an inlet valve 12 connected to the outlet line 4 of the main color changer is connected to a connecting line 13, sometimes called antenna, which is connected to the secondary circuit 11 via a flush three-way valve 14. A bleed system independent of the bleed system of the main changer is associated with the connecting line 13. This bleed system comprises a first bleed line 15 connected to the third passage of the flush valve 14, this first line 15 being connected to a solvent feed 16 and to a compressed gas feed 17 via a three-way valve 115. The bleed system comprises a second bleed line 18 of which one end is connected to a third passage of the inlet valve 12, to which the connecting line 13 is connected, and the other end is connected to the bleed manifold 10 of the main changer bleed system.

In the embodiment shown in FIG. 2, the connecting line 13 is preferably as short as permitted by the space available around the main changer 5. The bleeding is then carried out by closing the three-way valve 14 on the secondary circuit 11 side, the inlet valve 12 of the main changer on the main changer 5 side. The solvent and then the compressed air accordingly take the following path: first bleed line 15, connecting line 13, second bleed line 18, bleed manifold 10. The three-way valve 115 is adjusted to select the solvent intake for rinsing, then compressed air to expel the residual solvent to avoid overdiluting the next color.

Figure 3:
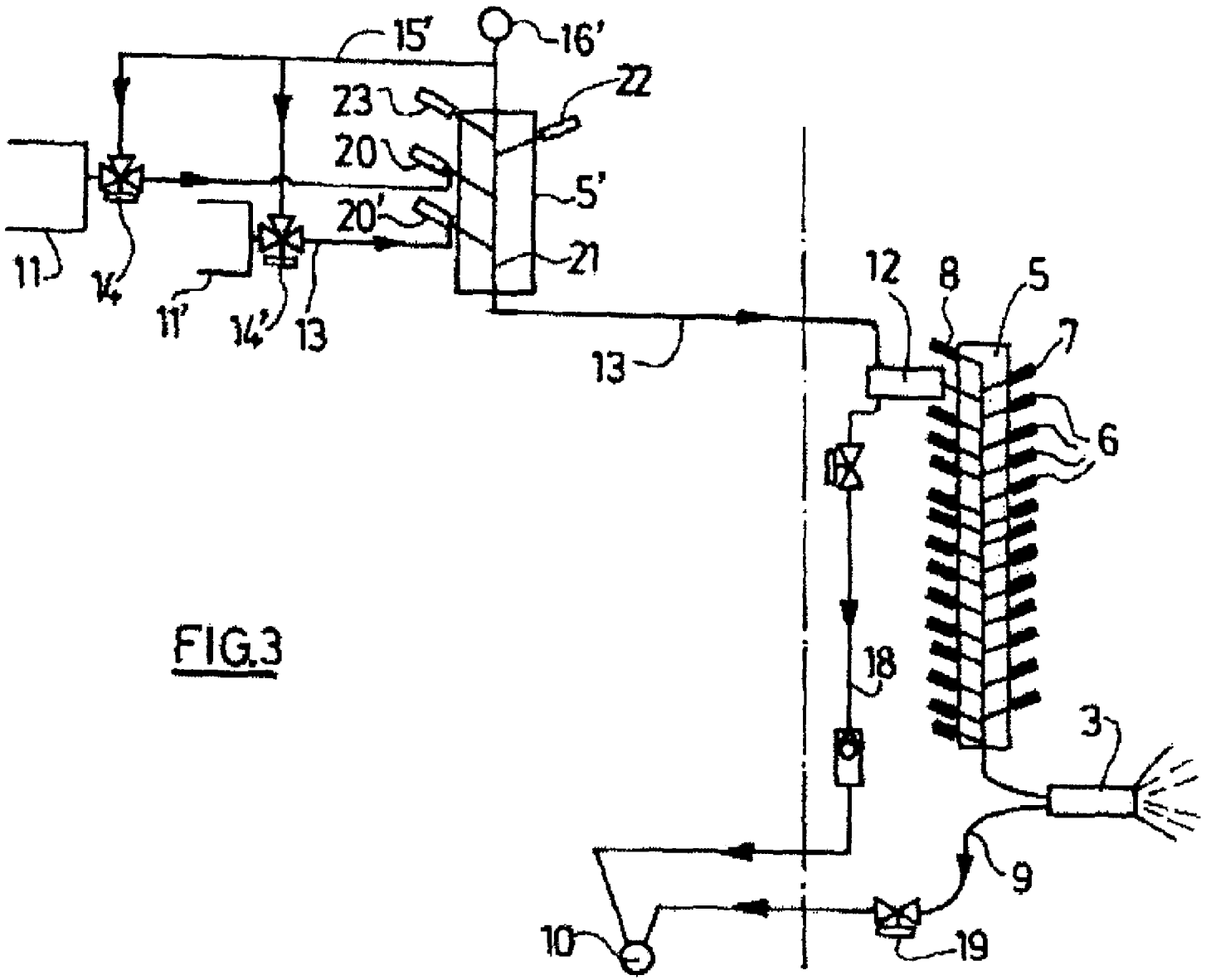
FIG. 3 is a schematic representation of a particular embodiment of a connecting line.

In a preferred embodiment shown in FIG. 3, a secondary color changer 5' is connected to the connecting line 13. This secondary changer 5' has a similar structure to that of a main changer 5. In the example, it comprises two inlet valves 20, 20' each connected to a secondary dispensing circuit 11, 11' via a flush valve 14, 14', and connected to the outlet line 21 of the secondary changer. The outlet of this outlet line is connected to the inlet valve 12 of the main changer. The secondary changer comprises, upstream of the inlet valves 20, 20', a solvent inlet solenoid valve 22 connected to a solvent manifold 16', and a compressed gas inlet valve 23 connected to a compressed air source (not shown). The inlet of the outlet line 21 from the secondary changer 5', located upstream of the solenoid valve 22 and of the valve 23, is connected via the first bleed line 15' to the third passages of the flush valves 14, 14'. The solvent manifold 16' is connected to this first bleed line 15' in order to supply solvent to the flush valves 14, 14' and the secondary changer 5'.

The bleeding of the connecting line 13 and the secondary color changer 5' is then carried out as follows. When the paint application is completed, the corresponding flush valve 14 (or 14') is closed on the secondary circuit 11 side, while the inlet valve 12 of the main changer is closed on the main changer side. The solvent, then the compressed gas, accordingly take the following path: first bleed line 15', flush valve 14, connecting line 13, corresponding inlet valve 20 of the secondary changer 5', outlet line 21 thereof, connecting line 13, inlet valve 12 of the main changer 5 (closed on the main changer side), then second bleed line 18, and bleed manifold 10. This bleed can therefore be carried out while another common color from a main circuit is applied in the cabin using the main changer 5.

During this bleed phase of the connecting line 13, the unused paint from the secondary circuit can be recovered and this circuit can be cleaned.

The structure of a secondary circuit is now described with reference to FIG. 1. A single secondary circuit 11 is shown in this figure. It comprises two paint tanks P1 and P2 each containing a rare color, a solvent tank S and a spent solvent recovery tank R. Each paint tank P1 and P2, and the solvent tank S, is associated with a circulating pump 24 controlled by the installation control system.

The secondary circuit also comprises a scraper storage and circulating system 25 and a dispensing device 26, such as a distribution plate, to send the fluids leaving the painting stations to one of the paint, solvent or recovery tanks.

Figure 4:
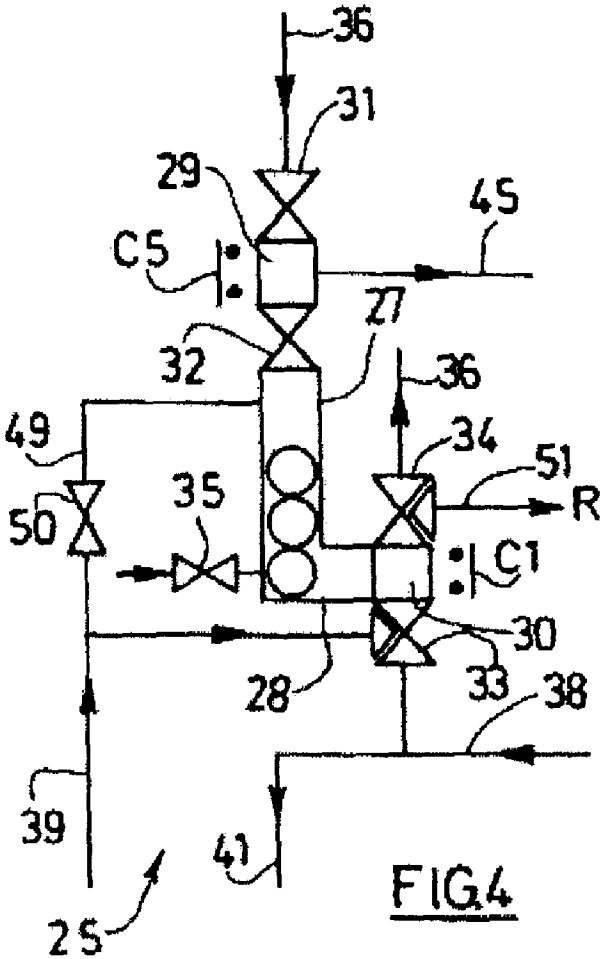
FIG. 4 is a schematic representation of a scraper storage and circulating system.

The scraper storage and circulating system 25 is described with reference to FIG. 4. It comprises a substantially L-shaped scraper storage trap 25, with a substantially vertical cylindrical part 27 in which the scrapers are stacked, and a substantially horizontal part 28. The scrapers are introduced from the top of the vertical part 27 via an inlet lock 29. The substantially horizontal part 28 of the storage trap has an outlet lock 30 at its end for the outlet of the scrapers. The inlet of the inlet lock 29 is connected to the secondary circuit via a valve 31, while its outlet communicates with the vertical part 27 via another valve 32. Similarly, the outlet lock 30 is connected in series to the secondary circuit via two three-way valves 33, 34 respectively permitting the inlet and outlet of the fluid in the lock 30. The outlet lock also communicates with the horizontal part 28. A solenoid valve 35 located at the end of the horizontal part 28, at the opposite end of the outlet lock, and connected to a compressed gas source, serves to move the scrapers from the bottom of the vertical part to the outlet lock 30.

The various components of the secondary circuit 11 are connected as follows.

A dispensing line 36 serves the painting stations 1 of the cabin. It supplies the connecting lines 13 of the painting stations. This dispensing line 36 is connected, upstream of the painting stations 1, to the outlet valve 34 of the outlet lock 30 of the storage trap. The line 36 is also connected to the inlet valve 29 of the trap inlet lock, downstream of the painting stations. The scrapers thereby only circulate in the dispensing line 36, between the outlet and inlet of the storage trap.

A valve 37 is connected to the dispensing line 36 downstream of the last painting station, immediately next to it.

The inlet valve 33 of the outlet lock 30 of the trap is connected to a paint feed line 38 and to a solvent feed line 39.

The paint feed line 38 is connected to the pump of the paint tank P1 via a quick coupling 40. Alternatively, it can also be connected to the pump of the paint tank P2. Upstream of the inlet valve 33 of the outlet lock 30, the paint feed line 38 is connected to the recovery tank R via a return line 41. A valve 42 placed on this line 41 is used to close it when the paint is sent to the painting stations.

The solvent feed line 39 is connected to the pump 24 of the solvent tank S via a valve 43. It is also connected, between the inlet valve 33 of the outlet lock 30 and this valve 43, to each of the paint tanks via two three-way valves 44 connected between the paint tank P1 or P2, and the associated circulating pump 24.

The inlet lock 29 of the trap comprises an outlet connected to a recovery line 45 to which the dispensing device 26 is connected. This device 26 is connected to the paint tanks P1, P2, the solvent tank S and the spent solvent recovery tank R, to send the fluid flowing in the recovery line 45 to the appropriate tank.

A compressed gas circuit 46 is connected to the solvent feed line 39, downstream of the valve 43 and close to it, via a check valve 47. A valve 48 upstream of this check valve is used to control the flow of compressed gas throughout the circuit.

A series of scraper position sensors C1 to C5 is distributed in the secondary circuit. Two sensors C1 and C5 are located at the outlet and inlet locks respectively of the storage trap, two other sensors C2 and C3 being located along the dispensing line 36 at the painting stations, and another sensor C4 being located just after the shutoff valve 37 of the dispensing line 36. These sensors are connected to the installation control system.

The lines of the secondary circuit 11 preferably have a smaller diameter than that of the piping used for the main dispensing circuits in order to decrease the quantity of paint necessary to load the circuit. This quantity is further reduced by placing the paint tanks and their circulating pump close to the painting stations. This makes it possible to use tanks with a capacity of about 25 liters, 5 liters being necessary to paint a vehicle, the remainder being used to load the circuit. Higher capacity tanks can obviously be used when several vehicles have to be painted with the same color. The low capacity of the paint tanks serves to place them on a trolley and to load them easily as required.

In an embodiment not shown, it is possible to connect, in parallel to the scraper circulating device, a second scraper circulating device connected to a second dispensing line serving other painting stations of the installation.

It is also possible to connect several secondary circuits to the secondary changers of the painting stations.

An example of an operating method of this secondary circuit is now described, the paint tank P1 being connected.

A first scraper is introduced into the outlet lock 30 of the storage trap. The inlet valve 33 and outlet valve 34 of this lock are then opened, and the circulating pump 24 of the paint tank P1 loads the circuit with paint. The paint is introduced through the line 38 of the circuit and pushes this first scraper into the dispensing line 36 until it is detected by the sensor C3, causing the stopping of the paint circulating pump 24 and the introduction of a second scraper into the circuit. The position of this sensor C3 corresponds to a sufficient quantity of paint introduced into the circuit to paint a vehicle.

The inlet valve 33 of the outlet lock 30 of the storage trap is then closed on the side of the paint tank P1 and opened on the side of the solvent feed line 39. The solvent is introduced by the pump of the solvent tank, and pushes the second scraper as well as the paint.

The sensor C4 is placed so that the quantity of paint introduced into the circuit is sufficient to supply each of the painting stations of the cabin. The detection of the first scraper by this sensor C4 causes the closure of the valve 37 of the dispensing line 36. The application of paint is triggered by the control system upon the entry of the car body to be painted in the application zone. During the paint application, the pump of the solvent tank S thereby maintains the pressure in the circuit. During this step, the inlet valves 12 and 20 of the main and secondary color changers of each station, corresponding to the secondary circuit, are opened to convey the paint to each application device 3. This opening can be controlled simultaneously or successively according to the progress of the vehicle in the cabin.

At the end of the paint application step, a signal is sent automatically, and causes the opening of the valve 37 of the dispensing line 36. The excess paint and solvent advance in the circuit until the second scraper is detected by the sensor C2. A third scraper is then introduced into the dispensing line 36, the solvent circulating pump 24 being temporarily stopped for this purpose, and pushed by a second quantity of solvent. The first scraper, followed by the unused paint, rejoins the inlet lock 29 of the storage trap. When this scraper is in the inlet lock (detection by the sensor C5), the inlet valve 31 of the lock is closed and its outlet valve 32 to the storage trap is opened, then closed after the scraper is removed. The inlet valve 31 of this lock is then opened again, and also its outlet to the recovery line 45. The paint can thereby be returned to the paint tank P1 using the dispensing device 26.

Until the first scraper returns to the storage trap, and is detected by the sensor C5, the dispensing device is preferably controlled to send the traces of fluids remaining in the lines (solvent or gas issuing from a previous use) to the recovery tank.

As soon as the third scraper is detected by the sensor C2, the solvent pump is stopped and a fourth scraper is introduced into the dispensing line 36. This fourth scraper is pushed by compressed gas introduced via the solvent/gas feed line 39.

The end of paint recovery can be controlled following a detection signal of one of the scrapers circulating in the circuit.

When the second scraper returns to the storage trap, the solvent that follows it is sent by the recovery line 45 to the dispensing device 26, then to the recovery tank R. When the third scraper rejoins this storage trap, the quantity of solvent that immediately follows it is sent similarly to the recovery tank, the final part of solvent, following the detection of the fourth scraper in the circuit, can be sent to the solvent tank S. When all the liquids have been recovered, the entire circuit is blown out with compressed gas to remove the solvent from the walls.

Before the departure of the fourth scraper, the solvent feed line 39 is used to circulate solvent in the paint feed line 38 and in its return line 41, the inlet valve 33 of the outlet lock of the storage trap being closed on the lock side, the valve 42 of the return line 41 to the spent solvent tank R being opened.

It is also possible to circulate solvent in the storage trap in order to rinse it, for example by using a line 49 provided with a valve 50 connecting the upper part of the storage cylinder 27 to the solvent feed line 39 upstream of the inlet valve 33 of the outlet lock of the storage trap, and a line 51 connecting a third passage of the outlet valve 34 from the outlet lock to the recovery tank. The solvent takes the following path, for example, (the outlet valve 32 of the inlet lock being closed, as well as the inlet valve 33 of the outlet lock): solvent feed line 39, line 49 (inlet valve 33 of the outlet lock closed on the line 39 side), vertical part 27, horizontal part 28, outlet valve 34 to the line 51, recovery tank R.

Other embodiments of a scraper storage and circulating device can obviously be used. The use of quick couplings to connect the various components of the secondary circuit makes it easier to change or replace these components.

The invention claimed is:

1. An automobile painting installation, comprising:

a plurality of painting stations each connected to a plurality of main common color paint dispensing circuits, each painting station including an application device supplied with paint via an outlet of a main color changer provided with a bleed system, each main color changer including a plurality of inlet valves each connected to a main common color dispensing circuit, the valves and application devices being controlled by a control system;

a secondary rare color paint dispensing and recovery system controlled by the control system and including at least one secondary paint dispensing and recovery circuit supplying the plurality of painting stations, with smaller dimensions compared with the main circuits, the secondary circuit comprising:

a scraper storage and circulating system including an inlet and an outlet connected respectively downstream and upstream of the painting stations to circulate the scrapers in a part of the secondary circuit supplying the stations, at least one rare color paint tank, one solvent tank, and one spent solvent recovery tank, connected upstream of the outlet of the scraper storage system, a dispensing device connected to the inlet of the scraper storage system, to send fluid exiting the painting stations to the paint, solvent, or recovery tanks, a plurality of connecting lines of which one end is connected to the secondary circuit by a flush three-way valve and the other end is connected to an inlet valve of a main color changer to supply paint from the at least one rare color paint tank to the main color changer, and an independent bleed system provided to each connecting line to bleed the connecting line between the flush three-way valve and the inlet valve of the main color changer, the independent bleed system including a second bleed line connected to the bleed system of the main color changer downstream of the application device such that solvent used to bleed the secondary circuit bypasses the main color changer upstream of the application device.

2. The installation as claimed in claim 1, wherein a secondary color changer is connected to each connecting line, the outlet of the color changer being connected to the inlet valve of the corresponding main color changer, and which includes at least one inlet valve connected to a secondary circuit via the flush three-way valve.

3. The installation as claimed in claim 1, wherein each independent bleed system of the connecting line includes a first bleed line connecting a solvent feed to the third passage of the flush valve, and the second bleed line connecting the corresponding inlet valve of the main color changer to a bleed manifold of the bleed system of the main color changer.

4. The installation as claimed in claim 1, wherein each secondary circuit and/or each bleed system of a connecting line is connected to a compressed gas feed.

5. The installation as claimed in claim 1, wherein the scraper storage and circulating system includes a storage trap of which the inlet and outlet are controlled by solenoid valves.

6. The installation as claimed in claim 5, wherein the storage trap has a substantially L-shaped tubular shape, of which upper and lower ends form the inlet and the outlet respectively, the scrapers being stored in the substantially vertical part.

7. The installation as claimed in claim 1, wherein each secondary circuit includes plural sensors to detect a position of the scrapers in the circuit, the sensors being connected to the control system.

8. The installation as claimed in claim 1, further comprising:

a controller configured to close the inlet valve and activate the independent bleed system such that the secondary circuit is bled while the main color changer dispenses paint from at least one of the main common color dispensing circuits via the application device.

* * * * *